US006209145B1

(12) United States Patent
Tillett

(10) Patent No.: US 6,209,145 B1
(45) **Date of Patent: *Apr. 3, 2001**

(54) BODY PROTECTION

(76) Inventor: Stephen Mark Tillett, Unit 3 Castleacre Industrial Estate, Castle Rd., Sittingbourne Kent (GB), ME10 3RL ( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/199,658

(22) Filed: Nov. 25, 1998

(30) Foreign Application Priority Data

Nov. 26, 1997 (GB) ..... 9724865

(51) Int. Cl.[7] ..... A41D 13/00

(52) U.S. Cl. ..... 2/464; 2/455; 2/456; 2/463; 2/465; 2/467

(58) Field of Search ..... 2/456, 464, 411, 2/412, 422, 92, 265, 908, 463, 465, 467, 455, 2

(56) References Cited

U.S. PATENT DOCUMENTS

| | | | |
|---|---|---|---|
| 3,921,222 | 11/1975 | Hollman | 2/2 |
| 3,945,041 | 3/1976 | Rhee | 2/2 |

FOREIGN PATENT DOCUMENTS

| | | |
|---|---|---|
| 37 19895 A1 | 12/1988 | (DE) . |
| 0 729 714 A2 | 9/1996 | (EP) . |
| 0 729 714 A3 | 3/1997 | (EP) . |
| WO 90/01883 | 3/1990 | (WO) . |

OTHER PUBLICATIONS

Von Karl Janda, "Kaufberatung Rippenschulzer," *Das Kart Magazin*, Jul. 1997, pp. 20–22—with copy of magazine cover, table of contents and English translation.

*Primary Examiner*—John J. Calvert
*Assistant Examiner*—Robert H. Muromoto, Jr.
(74) *Attorney, Agent, or Firm*—Townsend and Townsend and Crew LLP

(57) ABSTRACT

A device for protecting the body of an individual from impacts, comprises a first layer 10 of plastics material e.g. polypropylene which acts to protect from impacts the body of an individual wearing the device. To layer 10 is bonded a second layer 12 is of cross-linked polyethylene foam which acts to cushion the body of the individual The outer margin of layer 12 extends beyond the outer margin of layer 10 by between 5 and 20 mm, preferably 15 mm. A third textile fabric, e.g. terry towelling, layer 14 is attached to the second layer 12 and is generally coincident therewith. The layers 10, 12 and 14 are adhesively bonded together. Means for holding the device around the torso of an individual comprises a strip of textile fabric 22 comprising of or supporting hook-and-eye material for co-operation with a patch of hook-and-eye material 26, the strip of fabric material 22 and the patch 26 of book and eye material adhesively bonded to the surface of layer 10 at opposite ends 20, 38 of layer 10. Layer 10 is approximately 1.2 mm thick and the thickness of layer 12 is in the range of 5 to 10 mm.

16 Claims, 3 Drawing Sheets

BODY PROTECTION

DESCRIPTION

The invention relates to body protection, more particularly but not exclusively the protection of the torso and tibs of individuals.

In some competitive sports such as kart racing where there is little or no suspension in a vehicle being driven there is need for the drivers of the karts to have protection for their torso—particularly their ribs which come into contact with the seats of the vehicles being driven.

There are forms of torso or rib protector already known which generally comprise jackets or belts of textile fabric material including pockets into which relatively stiff panels, usually fibre reinforced plastics, are placed. The panels are meant to protect the ribs of a wearer of the jacket or belt.

The arrangements for protecting ribs known to me are uncomfortable to wear and do not provide, I believe, adequate protection of the ribs for those wearing them.

It is an object of the invention to provide an arrangement which alleviates and/or overcomes the difficulties found with the known forms of rib protector.

In one aspect the invention provides a device for protecting the body of an individual from impacts, the device comprising a first layer of material which acts to shield the body of an individual wearing the device to which is bonded a second layer of material which acts to cushion the body of the individual, the outer margin of the second layer extending beyond the outer margin of the first layer.

The outer margin of the second layer preferably extends between 5 and 20 mm beyond the outer margin of the first layer, desirably extends 15 mm beyond the outer margin of the first layer A third layer may be attached to the second layer and be generally coincident therewith.

The first layer may be a plastics material, for example polypropylene.

The second layer is preferably of a foamed plastics material, for example cross-linked polyethylene foam.

The third layer preferably comprises a textile fabric material, terry towelling.

With advantage the layers are adhesively bonded together.

The device preferably includes means for holding it in position wrapped about the torso of an individual.

The means for holding the device around the body of any individual preferably comprises a strip of textile fabric comprising of or supporting hook-and-eye for co-operation with a patch of hook-and-eye material, the strip of fabric material and the patch of hook-and-eye material being adhesively bonded to the surface of said first layer and at opposite ends of said layer.

A device for protecting the torso of an individual and embodying the invention will now be described with reference to the accompanying drawings in which.

The protective device shown in the Figures comprises three layers.

Figure 1:
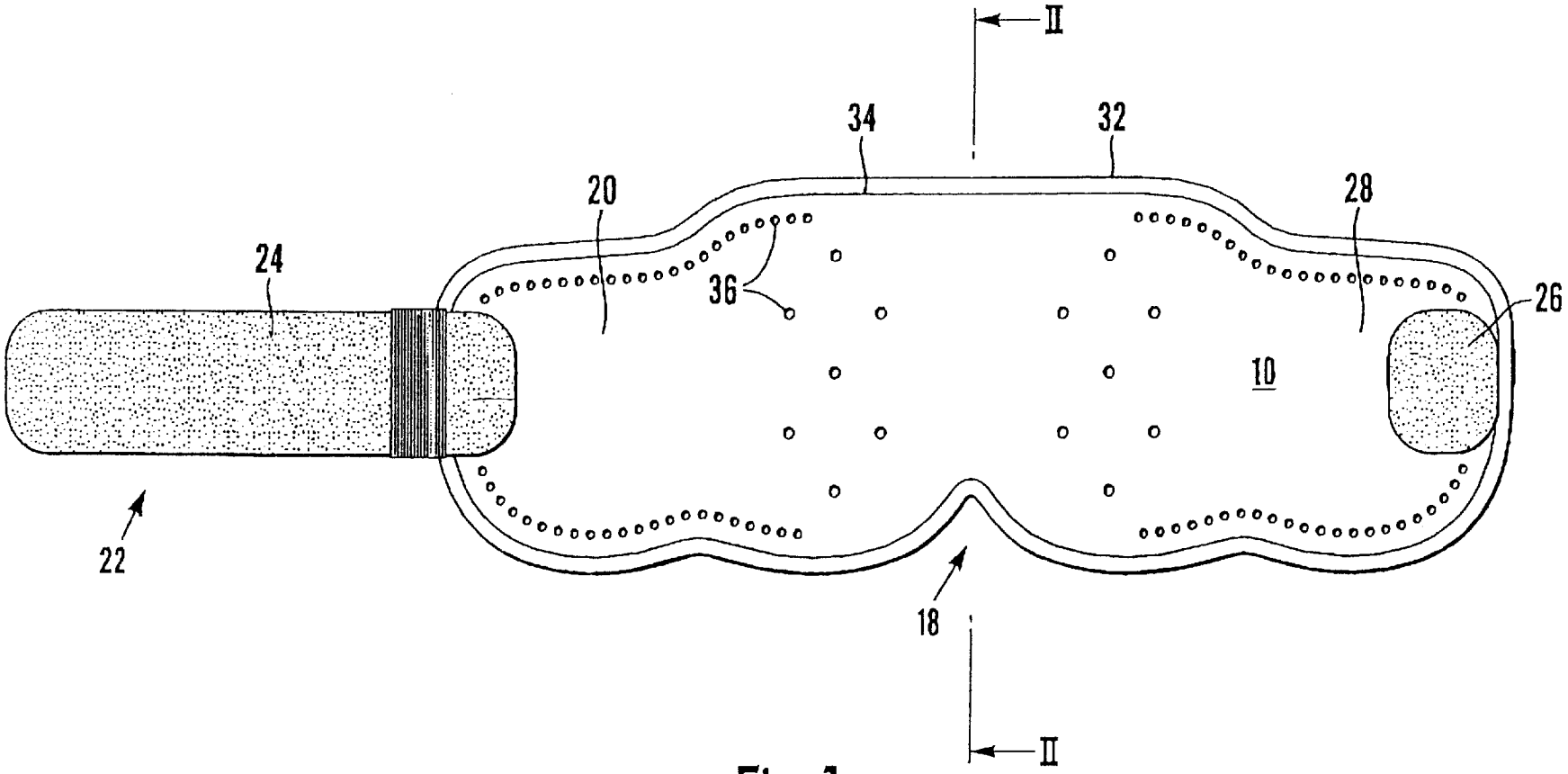
FIG. 1 is a face view of the device.
Figure 2:
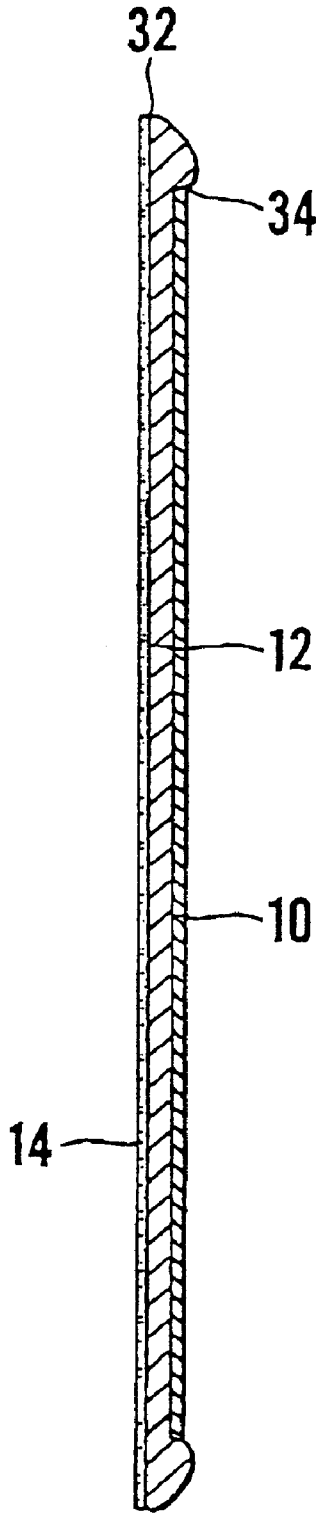
FIG. 2 is a sectional view drawn on the line II—II of FIG. 1.
Figure 3A:
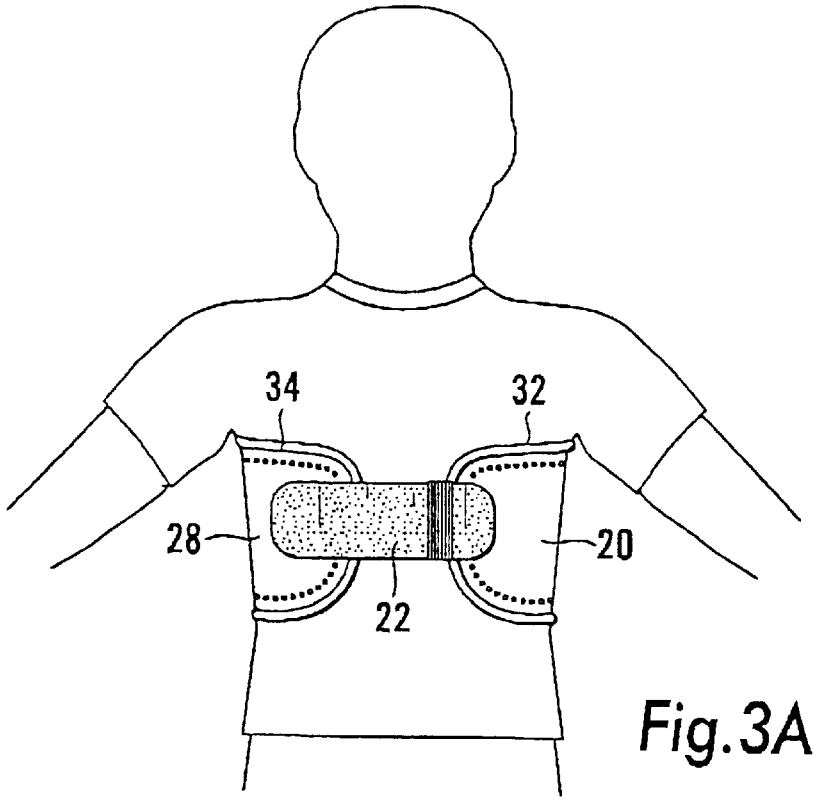
FIG. 3 shows at A and B front and rear views of an individual wearing the device.
Figure 3B:
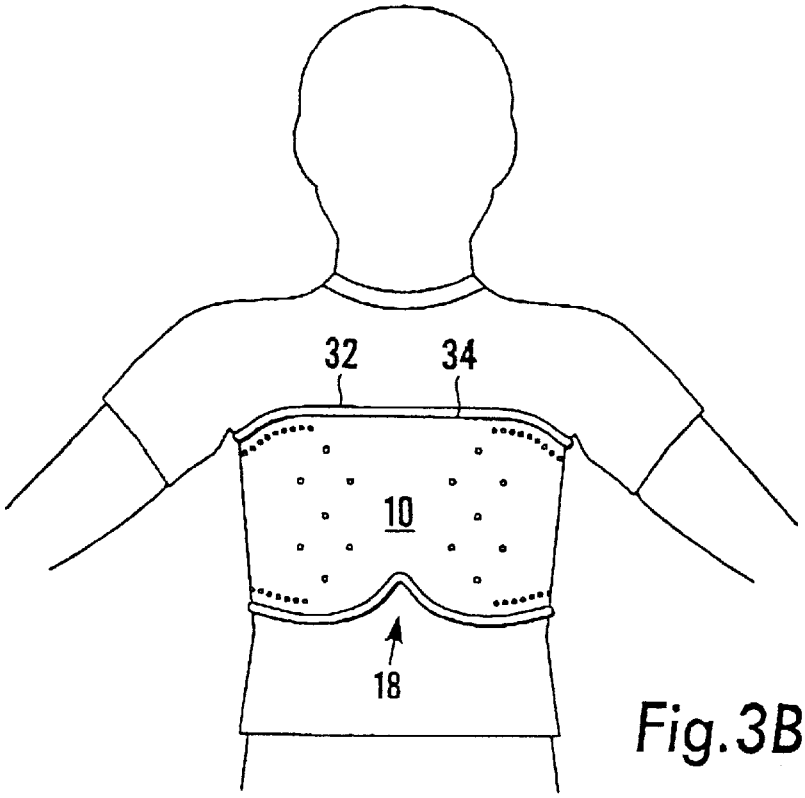

Layer 10 has generally the form shown in FIG. 1 and comprises a layer of polypropylene co-polymer desirably between 0.85 and 1.5 mm in thickness—preferably 1.2 mm thick.

The material of layer 10 has a specific gravity of 0.91 g/cc and a Rockwell hardness of 70.

To the layer 10 is adhesively bonded to a second layer 12 of cross-linked polyethylene foam of between 5 and 10 mm in thickness and having a density of between 50–70 kg/M$^3$. It is to be noted that the outer margin of the second layer 12 extends beyond that of the first layer 10 by approximately 15 mm.

The second layer 12 has adhesively bonded to it a third layer 14 of a textile fabric, for example terry towelling.

One end 20 of the layer 10 has bonded to it a flap of material 22 which comprises or supports an area of hook-and-eye material 24 for co-operating with a patch of hook-and-eye material 26 bonded to the surface adjacent the other end 28 of the layer after the device has been wrapped around the torso of a wearer.

It will be appreciated that after the device has been wrapped around the back of an individual with the ends 20; 28 passing beneath the armpits of the wearer the material patches 24 and 26 can be engaged to hold the protective device about the torso of the wearer.

As noted the outer margin 32 of the second layer 12 extends beyond the margin 34 of the first layer 10 by approximately 15 mm. It will be appreciated that the layer 12 is a relatively soft foam plastics material and the overlapping margin 34 acts to prevent the relatively stiffer layer 10 cutting into the torso of a wearer.

It is believed the device now proposed is lighter and more comfortable to wear and performs better protection that the devices presently known to me.

What is claimed is:

1. A device for protecting the torso of an individual from impacts, the device comprising:

a generally continuous first layer of material of a first shape which acts to shield the body of an individual wearing the device, wherein the first layer of material has a top surface, a bottom surface and an outer margin;

a second layer of material of a second shape which acts to cushion the body of the individual, the second layer hag a top surface, a bottom surface and an outer margin, wherein the top surface of the second layer is bonded to the bottom surface of the first layer, wherein the outer margin of the second layer extends beyond the outer margin of the first layer, and wherein the second layer is adapted to be placed between the individual and the first layers wherein the first shape includes an indent configured to be in line with the individual's spine and the second shape is substantially isomorphic to the first shape.

2. A device as claimed in claim 1, wherein the outer margin of the second layer extends between 5 and 20 mm beyond the outer margin of the first layer.

3. A device as claimed in claim 2, wherein the outer margin of the second layer extends 15 mm beyond the outer margin of the first layer.

4. A device as claimed in claim 1, further including a third layer attached to the bottom surface of the second layer and generally coincident therewith.

5. A device as claimed in claim 1, wherein the first layer made of a plastics material.

6. A device as claimed in claim 5, wherein the first layer is made of polypropylene.

7. A device as claimed in claim 1, wherein the second layer is made of a foamed plastics material.

8. A device as claimed in claim 7, wherein the second layer is made of cross-linked polyethylene foam.

9. A device as claimed in claim 4, wherein the third layer comprises a textile fabric material.

10. A device as claimed in claim 9, wherein the third layer is made of terry toweling.

11. A device as claimed in claim 1, wherein the layers are adhesively bonded together.

12. A device as claimed in claim 1, further including means for holding the device in position wrapped around the torso of the individual.

13. A device as claimed in claim 12, wherein the means for holding the device around the torso of the individual comprises a strip of textile fabric comprising of or supporting hook-and-eye material for co-operation with a patch of hook-and-eye material, the strip of textile fabric material and the patch of hook-and-eye material being adhesively bonded to the surface of the first layer and at opposite ends of the first layer.

14. A device as claimed in claim 1, wherein the first layer has a thickness between 0.85 and 1.50 mm.

15. The device as claimed in claim 14, wherein the first layer is substantially 1.2 mm in thickness.

16. The device as claimed in claim 1, wherein the second layer has a thickness in the range of 5 to 10 mm.

* * * * *